US011530867B2

(12) United States Patent
Yang et al.

(10) Patent No.: US 11,530,867 B2
(45) Date of Patent: Dec. 20, 2022

(54) REFRIGERATOR, DUCT ASSEMBLY AND DUCT FIXTURE

(71) Applicant: QINGDAO HAIER CO., LTD., Qingdao (CN)

(72) Inventors: Chun Yang, Qingdao (CN); Hao Zhang, Qingdao (CN); Enpin Xia, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 235 days.

(21) Appl. No.: 16/643,552

(22) PCT Filed: Dec. 26, 2018

(86) PCT No.: PCT/CN2018/123738
§ 371 (c)(1),
(2) Date: Feb. 29, 2020

(87) PCT Pub. No.: WO2019/141053
PCT Pub. Date: Jul. 25, 2019

(65) Prior Publication Data

US 2020/0200464 A1 Jun. 25, 2020

(30) Foreign Application Priority Data

Jan. 22, 2018 (CN) ..... 201810060745.5

(51) Int. Cl.
*F25D 21/14* (2006.01)

(52) U.S. Cl.
CPC ..... *F25D 21/14* (2013.01); *F25D 2321/143* (2013.01)

(58) Field of Classification Search
CPC ..... F25D 21/14; F25D 2321/143; F25D 2321/146; F16M 13/00; F16M 13/005; H02G 3/263
See application file for complete search history.

(56) References Cited

U.S. PATENT DOCUMENTS 7,537,290 B2 * 5/2009 Tye ..... B21C 23/085 301/124.1
8,465,221 B2 * 6/2013 Yan ..... H05K 7/1489 403/348

FOREIGN PATENT DOCUMENTS

CN 202152894 U * 2/2012
CN 202152894 U 2/2012
CN 203082432 U 7/2013
CN 103388950 A 11/2013
(Continued)

*Primary Examiner* — Ana M Vazquez
(74) *Attorney, Agent, or Firm* — Cheng-Ju Chiang

(57) ABSTRACT

The present invention provides a refrigerator, a duct assembly and a duct fixture. The duct fixture includes a fixing seat having a through hole, a fixing disk, a limiting block disposed on a side of the fixing disk adjacent to a target mounting surface, and a positioning protrusion disposed on the fixing disk, an outer shape of the limiting block matches a mounting hole on the target mounting surface, a limiting groove for receiving the target mounting surface is formed between the limiting block and the fixing disk, and the positioning protrusion is disposed angularly with the limiting block around the central axis of the through hole. When the limiting block rotates to a staggered position relative to the mounting hole, the positioning protrusion enters the mounting hole.

10 Claims, 3 Drawing Sheets

(56) References Cited

FOREIGN PATENT DOCUMENTS

| | | | | |
|---|---|---|---|---|
| CN | 203454544 | U | 2/2014 | |
| CN | 105737484 | A | 7/2016 | |
| CN | 105813871 | A | 7/2016 | |
| CN | 107084584 | A | 8/2017 | |
| CN | 107631536 | A | 1/2018 | |
| CN | 108332491 | A | 7/2018 | |
| DE | 10139964 | C1 | 11/2002 | |
| DE | 202008007363 | U1 | 8/2008 | |
| JP | H6-18146 | A | 1/1994 | |
| JP | H11-63795 | A | 3/1999 | |
| JP | 2003-56975 | A | 2/2003 | |
| WO | WO-2017002248 | A1 * | 1/2017 | ..... F16L 37/24 |

* cited by examiner

REFRIGERATOR, DUCT ASSEMBLY AND DUCT FIXTURE

The present application is a 35 U.S.C. § 371 National Phase conversion of International (PCT) Patent Application No. PCT/CN2018/123738, filed on Dec. 26, 2018, which claims priority to Chinese Patent Application No. 201810060745.5, filed on Jan. 22, 2018 and titled "REFRIGERATOR, DUCT ASSEMBLY AND DUCT FIXTURE", which is incorporated herein by reference in its entirety. The PCT International Patent Application was filed and published in Chinese.

TECHNICAL FIELD

The present invention relates to the technical field of duct connection, particularly to a duct fixture, and further to a duct assembly and a refrigerator to which the duct assembly is applied.

BACKGROUND

As for a conventional refrigerator, a water drain system is an indispensable portion of the refrigerator. The most important portion in the whole water drain system is a water drain duct fitting which acts as a connector and is responsible for completing connection of a water drain port of a cabinet interior with a water drain duct.

The quality of the water drain duct fitting directly affects the performance of the water drain system of the refrigerator, and finally affects the use performance of the refrigerator. However, when the refrigerator foams, the foaming liquid easily penetrates into the drain water duct from an interface of the water drain port and the water drain duct, and causes the occurrence of the closing of the water drain duct. A conventional solution is to use an adhesive tape to seal the connecting position of the water drain port and the water drain duct, but the sealing effect is usually undesirable, and the foaming liquid still penetrates into the water drain duct. Furthermore, the operation of using the adhesive tape to seal the connecting position is complicated, time-consuming and laborious, which substantially reduces the assembling efficiency of products.

In view of the above, it is necessary to provide a novel duct fixture to solve the above problem.

SUMMARY

An object of the present disclosure is to provide a novel duct fixture, which can address problems such as loose connection of an end of the duct and a target mounting surface and undesirable sealing.

To achieve the above object of the present invention, the present invention employs the following technical solutions: a duct fixture for fixing an end of a duct to a target mounting surface, the target mounting surface being provided with a mounting hole, the duct fixture comprising:

a fixing seat in which is formed with a through hole communicated with the end of the duct, the through hole having a central axis;

a fixing disk formed as an end face of the fixing seat;

a limiting block provided on a side of the fixing disk adjacent to the target mounting surface and shaped to match the mounting hole; a limiting groove operably rotating to receive the target mounting surface is formed between the limiting block and the fixing disk;

wherein the duct fixture further comprises a positioning protrusion disposed on the fixing disk, the positioning protrusion is disposed angularly with the limiting block around the central axis so that when the limiting block moves relative to the mounting hole from an aligned position to a staggered position, the positioning protrusion enters the mounting hole to limit further rotation of the duct fixture.

As an improved technical solution of the present invention, an axial distance between a bottom surface of the limiting block and the fixing disk is X, a height of the positioning protrusion is Y, a thickness of the target mounting surface is H, wherein $H<X$, $X-H<Y<X$.

As an improved technical solution of the present invention, the bottom surface of the limiting block comprises an inclined surface to facilitate the limiting block to rotate from the aligned position to the staggered position.

As an improved technical solution of the present invention, a length of the positioning protrusion in the rotation direction is consistent with a width of the limiting block.

As an improved technical solution of the present invention, the fixing disk is provided with two oppositely-arranged positioning protrusions, and a connection line of profiles of the two positioning protrusions is consistent with an outer shape of the limiting block.

As an improved technical solution of the present invention, a connection line between the positioning protrusion and the central axis is perpendicular to the limiting block.

As an improved technical solution of the present invention, the fixing seat comprises a duct wall surrounding to form the through hole, and a plurality of supporting ribs are provided on an outer periphery of the duct wall.

As an improved technical solution of the present invention, the fixing seat comprises four supporting ribs, and the four supporting ribs are evenly distributed along the outer periphery of the duct wall.

To achieve the above object of the present invention, the present invention further provides a duct assembly, comprising a duct and a duct fixture for fixing an end of a duct to a target mounting surface, wherein the duct fixture is the above-mentioned duct fixture.

To achieve the above object of the present invention, the present invention further provides a refrigerator comprising a cabinet, the cabinet comprising an inner shell, the inner shell being provided with a target mounting surface, a duct assembly being provided in the cabinet, wherein the duct assembly comprises a duct and the above-mentioned duct fixture, wherein the duct fixture is used to fix an end of the duct to the target mounting surface.

Advantageous effects of the present invention are as follows: as compared with the prior art, when the duct fixture provided by the present invention is mounted to the target mounting surface, it is axially limited by the engagement of the limiting groove and the target mounting surface, and the circumferential rotation of the duct fixture is also limited with the positioning protrusion being disposed, so that the connection of the duct fixture and the target mounting surface is firm, and the sealing is reliable, thereby solving the problem in the prior art that water leakage and air leakage are likely to be caused by loose connection at the connecting position of the duct fixture and the water drain port (or exhaust port).

DETAILED DESCRIPTION

Figure 1:
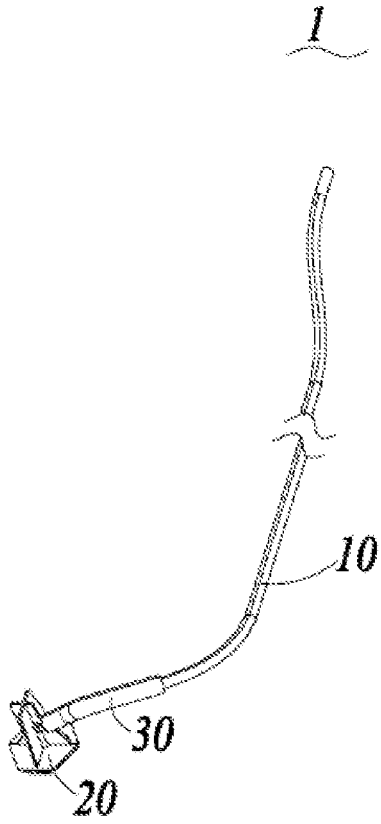
FIG. 1 is a schematic diagram of an assembling structure of a duct assembly in a preferred embodiment of the present invention.

The present invention will be described below in detail in combination with specific embodiments illustrated in drawings. However, these embodiments have no limitations on the present invention, and any transformations of structure, method, or function made by persons skilled in the art according to these embodiments fall within the protection scope of the present invention.

The terms expressive of spatial relative positions, such as "upper", "above", "lower", "below", or the like herein are used to describe the relationship of a unit or feature relative to another unit or feature in the drawings, for the purpose of illustration and description. Terms expressive of the spatial relative positions are intended to comprise different orientations of the device in use or operation other than the orientations shown in the drawings. For example, if the device in the drawings is turned over, the units which are described to be located "below" or "under" other units or features are "above" other units or features. Therefore, the exemplary term "below" may comprise both the "above" and "below" orientations. The device may be oriented (rotated by 90 degrees or other orientations) in other ways, correspondingly explaining the expressions related to the space herein. Also, it should be understood that although the terms of first, second, etc. may be used herein to describe various elements or structures, these described objects should not be limited by them. These terms are merely used to distinguish these described objects.

Figure 2:
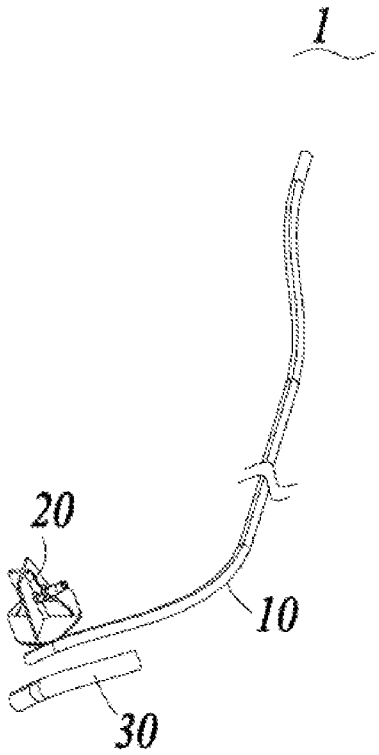
FIG. 2 is a schematic exploded view of the structure of the duct assembly shown in FIG. 1.

As shown in FIG. 1 and FIG. 2, a preferred duct assembly 1 according to the present invention comprises a duct 10 and a duct fixture 20 for fixing an end of the duct 10 to a target mounting surface, wherein the duct 10 may be a water drain duct 10 or an air-conditioning duct 10. The target mounting surface may be provided on an inner shell of the refrigerator. After the duct assembly 1 is mounted on the target mounting surface between the inner shell and outer shell of the refrigerator, the refrigerator is then subjected to foaming processing so that the duct assembly 1 is positioned in the foaming layer of the refrigerator. Certainly, the target mounting surface may also be disposed on the housing of other machines or parts.

Figure 3:
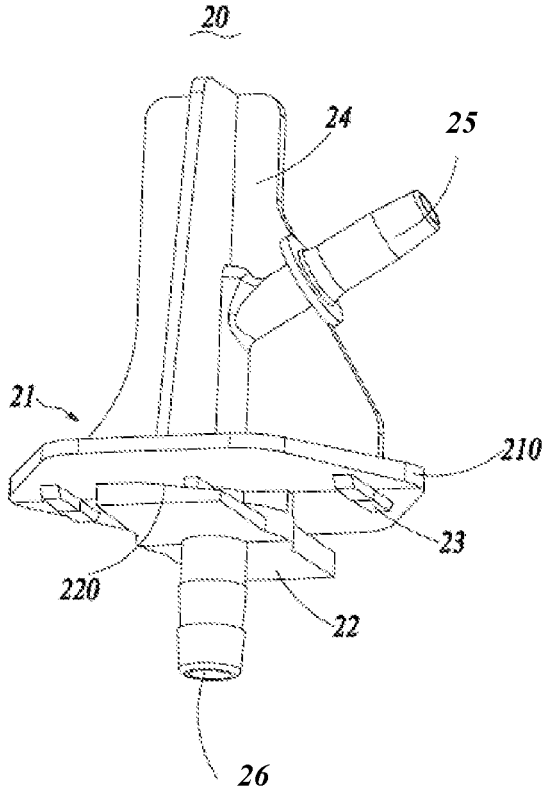
FIG. 3 is a perspective view of a duct fixture in a preferred embodiment of the present invention.
Figure 6:
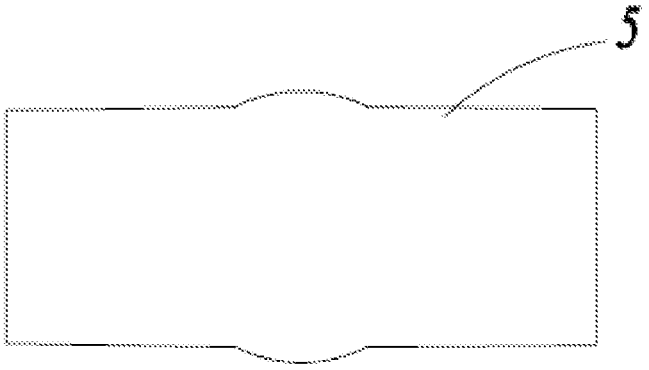
FIG. 6 is a schematic structural diagram of a target mounting hole in a preferred embodiment of the present invention.

As shown in FIG. 3 and FIG. 6, a duct fixture 20 is used to fix an end of the duct 10 to a target mounting surface. The target mounting surface is provided with a mounting hole 5. The duct fixture 20 comprises: a fixing seat 21 in which is formed with a through hole communicated with the end of the duct 10, the through hole having a central axis; a fixing disk 210 formed as an end face of the fixing seat 21; a limiting block 22 provided on a side of the fixing disk 210 adjacent to the target mounting surface and shaped to match the mounting hole 5; a limiting groove operably rotating to receive the target mounting surface is formed between the limiting block 22 and the fixing disk 210; wherein the duct fixture 20 further comprises a positioning protrusion 23 disposed on the fixing disk 210, the positioning protrusion 23 is disposed angularly with the limiting block 22 around the central axis so that when the limiting block 22 moves relative to the mounting hole 5 from an aligned position to a staggered position, the positioning protrusion 23 enters the mounting hole 5 to limit further rotation of the duct fixture 20. When the duct fixture 20 provided by the present embodiment is mounted to the target mounting surface, it is axially limited by the engagement of the limiting groove and the target mounting surface, and the circumferential rotation of the duct fixture 20 is also limited with the positioning protrusion 23 being disposed, so that the connection of the duct fixture 20 and the target mounting surface is firm, and the sealing is reliable, thereby solving the problem in the prior art that water leakage and air leakage are likely to be caused by loose connection at the connecting position of the duct fixture 20 and the water drain port (or exhaust port).

In the present embodiment, an axial distance between a bottom surface of the limiting block 22 and the fixing disk 210 is X, a height of the positioning protrusion 23 is Y, a thickness of the target mounting surface is H, and X-H is not greater than Y. The space between the limiting block 22 and the fixing disk 210 is formed as the above-mentioned limiting groove, and the axial distance X is the height of the limiting groove. When the duct fixture 20 is mounted, along with the rotation of the fixing disk 210 and limiting block 22, the target mounting surface at the edge of the mounting hole 5 gradually enters the limiting groove, and the thickness H of the target mounting surface is not greater than the height X of the limiting groove. As such, the fitting of the duct fixture 20 and the target mounting surface is interference fitting and facilitates the limitation of the duct fixture 20 along the axial direction of the through hole.

In addition, while the limiting block 22 rotatably moves from the position aligned with the mounting hole 5 to the position staggered from the mounting hole 5, the position protrusion 23 simultaneously enters the position of the mounting hole 5 as the fixing disk 210 rotates about the central axis by the same angle. After the positioning protrusion 23 snap fits in the mounting hole 5, the limiting block 22 cannot continue to rotate and cannot rotate reversely, and the circumferential rotation of the limiting block 22 around the central axis is limited. The height Y of the positioning protrusion 23 is between X−H and X so that when the limiting block 22 is positioned, the height of the positioning protrusion 23 is proper, which does not cause the duct fixture 20 to shake axially and does not make the rotation process exceptionally hard.

Figure 4:
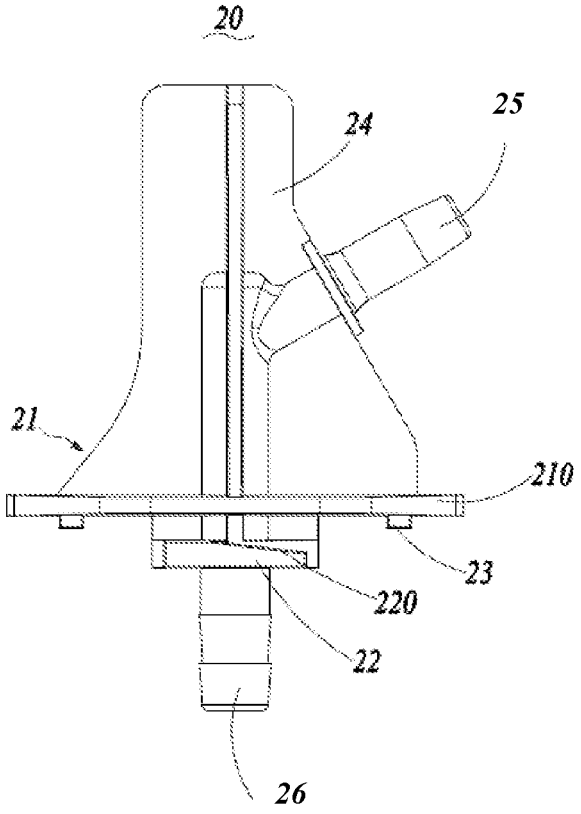
FIG. 4 is a front view of the duct fixture shown in FIG. 3.

Referring to FIG. 3 and FIG. 4, the bottom surface of the limiting block 22 comprises an inclined surface 220 to facilitate the limiting block 22 to rotate from the aligned position to the staggered position. The provision of the inclined surface 220 facilitates the rotation of the limiting block 22.

Figure 5:
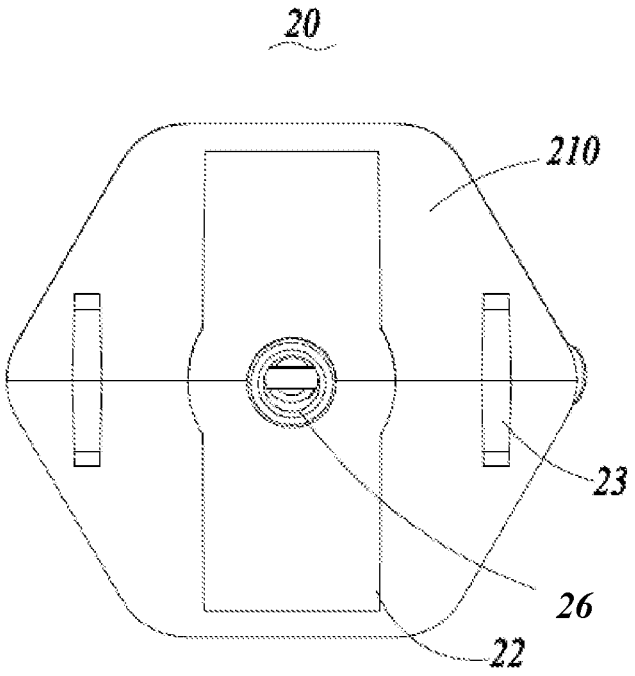
FIG. 5 is a bottom view of the duct fixture shown in FIG. 3.

As shown in FIG. 5, a length of the positioning protrusion 23 in the rotation direction is consistent with a width of the limiting block 22. Since the mounting hole 5 is shaped consistent with the limiting block 22, the design that the length of the positioning protrusion 23 in the rotation direction is consistent with the width of the limiting block 22 causes that both ends of the positioning protrusion 23 in the rotation direction to respectively abut against both sides of the mounting hole 5, thereby optimizing the limiting effect.

In the present embodiment, the fixing disk 210 is provided with two oppositely-arranged positioning protrusions 23, and a connection line of profiles of the two positioning protrusions 23 is consistent with the outer shape of the limiting block 22, so that when the limiting block 22 rotates to the staggered position, the positioning protrusions 23 enter both ends of the mounting hole 5, and the positioning protrusions 23 located at both ends of the mounting hole 5 increase a torque, thereby increasing resistance to be overcome when the duct fixture 20 rotates reversely or further rotates so that the positioning of the duct fixture 20 is more reliable.

Further referring to FIG. 5, a connection line between the positioning protrusion 23 and the central axis is perpendicular to the limiting block 22. The setting of the vertical angle facilitates the structural design of the positioning protrusion 23 and the limiting block 22. As such, when the duct fixture 20 is mounted, the limiting block 22 rotates 90° from the position aligned with the mounting hole 5, thereby completing the positioning.

Referring to FIG. 3 and FIG. 4, the fixing seat 21 comprises a duct wall surrounding to form the through hole, and a plurality of supporting ribs 24 are provided on the outer periphery of the duct wall. The arrangement of the supporting ribs 24 facilitates protecting the duct wall and avoids bending and damages at a position between the end of the duct 10 and the mounting hole 5 for a reason such as steering. In the present embodiment, the fixing seat 21 comprises four supporting ribs 24, and the four supporting ribs 24 are evenly distributed along the outer periphery of the duct wall.

In the present embodiment, the duct wall comprises an inlet duct 25 and an outlet duct 26, wherein the inlet duct 25 is connected to the end of the duct 10, the outlet duct 26 is connected to the target mounting surface, and the inlet duct 25 is disposed angularly with the outlet duct 26.

Referring again to FIG. 1 and FIG. 2, the duct assembly 1 comprises the duct 10 and the duct fixture 20, wherein an end of the duct 10 is interference fit with the duct fixture 20, and the end of the duct 10 is received in the through hole of the duct fixture 20. Certainly, it is also possible that the duct fixture 20 may be received in a hole at the end of the duct 10. In the present embodiment, the duct assembly 1 further comprises a protective pipe 30. The protective pipe 30 is used to shield the connecting position after the end of the duct 10 is connected to the duct fixture 20, thereby preventing the connecting position from being bent to disconnect the end of the duct 10 from the duct fixture 20.

The embodiment of the present invention further comprises a refrigerator comprising a cabinet, the cabinet comprising an inner shell, the inner shell being provided with a target mounting surface, the above-mentioned duct assembly 1 being provided in the cabinet.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. A duct fixture, for fixing an end of a duct to a target mounting surface, the target mounting surface being provided with a mounting hole, the duct fixture comprising:

a fixing seat in which is formed with a through hole communicated with the end of the duct, the through hole having a central axis;

a fixing disk formed as an end face of the fixing seat;

a limiting block provided on a side of the fixing disk facing the target mounting surface and shaped to match the mounting hole; wherein a limiting groove operably rotating to receive the target mounting surface is formed between the limiting block and the fixing disk;

wherein the duct fixture further comprising a positioning protrusion disposed on the fixing disk, the positioning protrusion is disposed angularly with the limiting block around the central axis and is disposed to be spaced away from the limiting block so that when the limiting block is in an aligned position relative to the mounting hole, the limiting block enters the mounting hole axially, the positioning protrusion stays away from the mounting hole, the limiting block and the positioning protrusion are located on two opposite sides of the target mounting surface respectively, and when the limiting block moves around the central axis relative to the mounting hole from the aligned position to a staggered position, the positioning protrusion enters and snap fits in the mounting hole to limit further rotation of the duct fixture and limit rotation reversely of the duct fixture.

2. The duct fixture according to claim 1, wherein an axial distance between a bottom surface of the limiting block and the fixing disk is X, a height of the positioning protrusion is Y, a thickness of the target mounting surface is H, wherein $H<X$, $X-H<Y<X$.

3. The duct fixture according to claim 2, wherein the bottom surface of the limiting block comprises an inclined surface to facilitate the limiting block to rotate from the aligned position to the staggered position.

4. The duct fixture according to claim 1, wherein a length of the positioning protrusion along a rotation direction of the positioning protrusion is consistent with a width of the limiting block along the rotation direction.

5. The duct fixture according to claim 1, wherein the fixing disk is provided with two oppositely-arranged positioning protrusions, and a connection line of profiles of the two positioning protrusions is consistent with an outer shape of the limiting block.

6. The duct fixture according to claim 1, wherein a connection line between the positioning protrusion and the central axis is perpendicular to the limiting block.

7. The duct fixture according to claim 1, wherein the fixing seat comprises a duct wall surrounding to form the through hole, and a plurality of supporting ribs are provided on an outer periphery of the duct wall.

8. The duct fixture according to claim 7, wherein the fixing seat comprises four supporting ribs, and the four supporting ribs are evenly distributed along the outer periphery of the duct wall.

9. A duct assembly, wherein comprising a duct and the duct fixture according to claim 1, the duct fixture being used to fix an end of the duct to the target mounting surface.

10. A refrigerator, comprising a cabinet, the cabinet comprising an inner shell, the inner shell being provided with a target mounting surface, a duct assembly being provided in the cabinet, wherein the duct assembly comprises a duct and the duct fixture according to claim 1, the duct fixture is used to fix an end of the duct to the target mounting surface.

* * * * *